US005257595A

United States Patent [19]

Cassidy, Jr.

[11] Patent Number: 5,257,595

[45] Date of Patent: Nov. 2, 1993

[54] FLAG SYSTEM

[75] Inventor: John F. Cassidy, Jr., Golden Valley, Minn.

[73] Assignee: Fern Island, Incorporated, Golden Valley, Minn.

[21] Appl. No.: 967,106

[22] Filed: Oct. 27, 1992

[51] Int. Cl.[5] ..... G09F 11/00

[52] U.S. Cl. ..... 116/321; 116/281

[58] Field of Search ..... 116/321, 322, 323, 324, 116/281; 40/488, 491; 235/69

[56] References Cited

U.S. PATENT DOCUMENTS

| | | | |
|---|---|---|---|
| 553,555 | 1/1896 | Doster | 116/321 |
| 588,254 | 8/1897 | Walker | 116/324 X |
| 1,101,826 | 6/1914 | Woolums | 116/324 |
| 2,610,792 | 9/1952 | Kaufman | 235/69 |
| 2,776,638 | 1/1957 | Whitaker | 116/324 |
| 2,895,448 | 7/1959 | Haines | 116/324 |
| 3,554,159 | 1/1971 | Klupt | 116/323 X |
| 5,136,965 | 8/1992 | Tamburro, Jr. | 116/321 |

OTHER PUBLICATIONS

Brochure entitled "Clinic Speciality Company-A Complete Line of Custom Medical Accessories", p. 4, 1991.

Catalog entitled "Medical Arts Press", Fall/Winter 1991, Office Essentials for the Medical Professions, What's New!; ©1991 Medical Arts Press, p. 109.

Catalog entitled "Colwell—Your Medical Practice Management Partner", Fall 1991, In The News; ©1991 Colwell Systems, p. 96.

*Primary Examiner*—Daniel M. Yasich

*Attorney, Agent, or Firm*—Fredrikson & Byron

[57] ABSTRACT

A flag signaling system for conveying information. Colored flags are slidably attached to a cassette. The flags can be extended to positions away from the cassette as a means of communicating information. Symbols can also be printed on the flags, thereby expanding the information carried by the flags. The flags can be produced in a variety of colors and are easily replaceable if the user so desires. Although there are standard primary and designer colors for the slides, there are over 400 designer colors to select on a custom basis. Different flag units will be manufactured by a variety of conventional and modern techniques, such as laser cutting and injection molding.

1 Claim, 4 Drawing Sheets

FLAG SYSTEM

FIELD OF THE INVENTION

The present invention relates to a device which can be used for communicating information in professional offices or other locations. The device comprises a cassette containing various colored flags that can be extended to multiple status indicating positions.

BACKGROUND OF THE INVENTION

Stationary signaling units can be used in a variety of settings. A common application of the units is medical clinics and professional offices where they are a convenient and efficient means of conveying information to the staff.

Typical signaling units consist of several flags hinged to a base, the flags hinge flat against a wall to which the base is mounted. When a patient is brought into an examination room, the flag corresponding to the doctor responsible for seeing the patient is swung out from the base. After the doctor is finished with the examination, he or she will reposition the flag against the wall.

Such systems, however, are outdated both in function and design. The prior art signaling units have only two signaling positions. One position has the flag adjacent to the wall; the other has the flag perpendicular to the wall. Thus, the user is limited in the amount of information that can be conveyed by the unit. Additionally, the color and design options available for the flags are limited and the flags are usually difficult to replace if broken.

A need exists, therefore, for a signaling unit that is adaptable to unique situations, is flexible enough to allow the user to convey large and diverse amounts of information, can be tailored to the individual user's tastes and is aesthetically acceptable with modern interior design standards.

SUMMARY OF THE INVENTION

The present invention concerns a flag system signaling device that is comprised of a cassette containing a plurality of recesses and flags located within the recesses. The flags are able to slide within the recesses and can be extended outward from the cassette. The extended positions of the flags can be used to indicate status and convey information. The flags are differently colored and can have numbers or letters printed on them to represent various criteria. The flag system is mounted to the surface of a structure or a collar can be placed around the cassette so that the cassette can then be recess mounted within the structure up to the collar.

The flags are easily replaced and all of the colors of the system can be altered. The flags have a variety of positions and can be used to represent an unlimited number of factors thus allowing the system to be very versatile. Additionally, recessing the flags within the cassette enables the system to "hide" 80% of the flags while they are not activated, thereby eliminating much of the "aesthetic clutter" present with prior art systems.

DETAILED DESCRIPTION OF THE INVENTION

Figure 1:
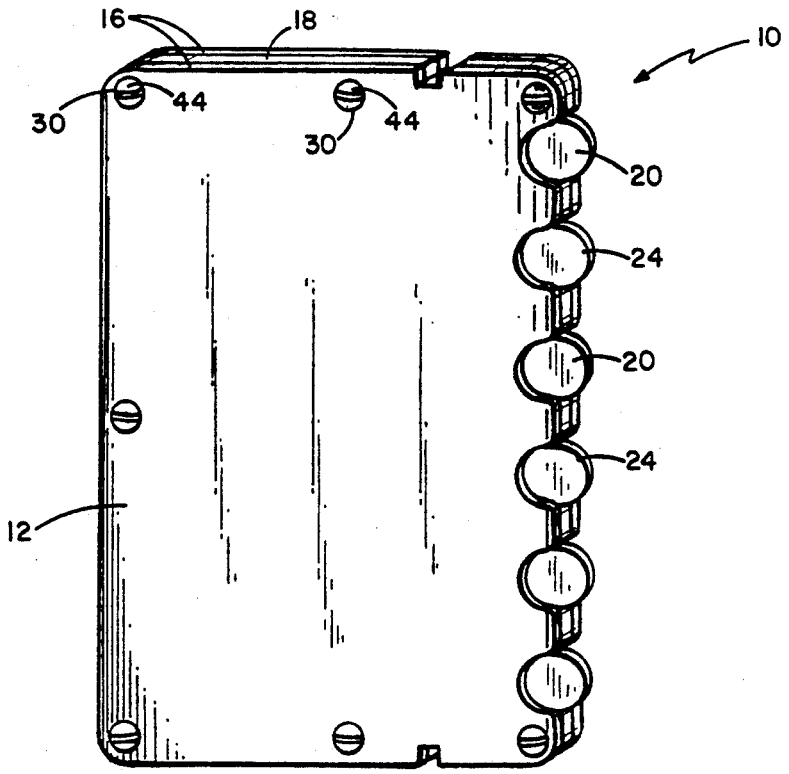
FIG. 1 is a perspective view of the invention.
Figure 2:
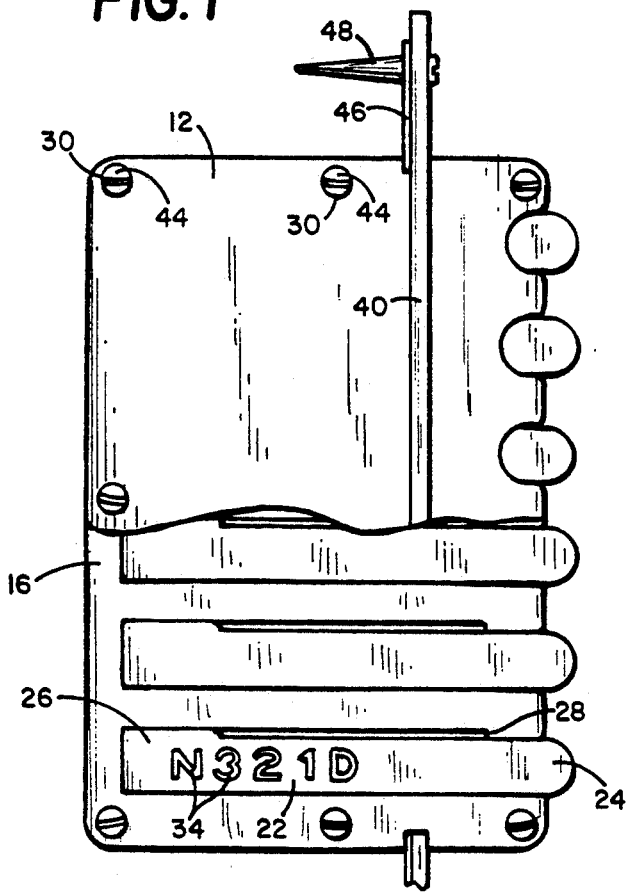
FIG. 2 is a side view and partial cross sectional view of the invention.

A flag system of the invention is generally designated 10 in FIG. 1 and is comprised of a cassette 12 and flags 20. The flags 20 are attached to the cassette 12 so that they are free to move laterally in respect to the cassette 12. In the preferred embodiment, the cassette 12 contains recesses 14 (FIG. 4) in which the flags 20 are placed. The recesses 14 can be of any suitable length necessary to support the flags 20 and, as shown in FIG. 2, in the preferred embodiment, the recesses 14 run substantially the length of the cassette 12.

The cassette 12 can be constructed in any appropriate fashion, however, in the preferred embodiment, the cassette 12 comprises a generally rectangular frame 16 which contain the recesses 14 and side walls 18. The side walls 18 abut the frame 16 and, when secured to the frame 16, allow only the lateral movement of the flags 20 within the recesses 14. The side walls 18 will usually be visible to the user and can be constructed or covered with any suitable material, the desired surface of the side walls 18 most often being dictated by aesthetics. Typical material the side walls 18 could be constructed of include clear or colored plastic, wood or laminated paneling and wall vinyl.

The side walls 18 are desirably secured to the frame 16 in a manner which allows for the easy removal and reattachment of the side walls 18 so that the flags 20 can be withdrawn from the frame 16 for maintenance or replacement. In the preferred embodiment, holes 30 are located along the outside edges of the frame 16 and side walls 18 through which pins 44 pass to hold the frame and side wall assembly together. Screws, pegs or other appropriate attachment means may be used.

The recesses 14 house the flags 20 and allow the flags 20 to be laterally extended outward of the cassette interior. Any suitable configuration of flags 20 can be used so long as the flags 20 are permitted to be extracted from the cassette 12 in the above stated manner. Although any suitable configuration will suffice, in the preferred embodiment, the body 22 of the flag 20 is substantially rectangular and has a width slightly less than that of the recess 14, thereby permitting the flag 20 to slide within the recess 14 without excess longitudinal movement. The profile of the head 24 of the flag 20 can be of any appropriate configuration and will be dictated primarily by aesthetics. In the preferred embodiment, however, the body 22 of the flag 20 terminates in an arcuate head 24.

Depending upon the intended application, the cassette 12 can be of any suitable dimensions. Similarly, any number of recesses 14 can be located within the cassette 12 and/or any number of flags 20 can be used. In preferred embodiments, the cassette 12 contains four or six flags 20.

The length of the flags 20 is desirably slightly longer than that of the recess 14 so that at least some portion of the flag 20 is visible when the flag 20 is fully retracted within the cassette 12. This permits the user of the system to visually locate the desired flag and allows for easy grasping of the flag for repositioning. In the preferred embodiment, the side walls 18 contain corresponding arcuate indentations 32 over the recesses 14 to facilitate the visual enhancement of the flags 20 and the ease of grasping the flags 20.

Figure 6A:
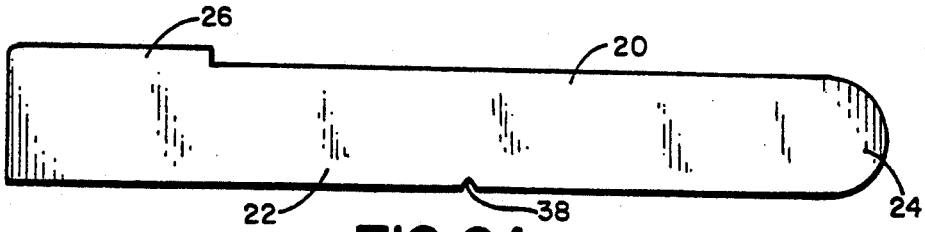
FIG. 6A is a side view of a flag.
Figure 6B:
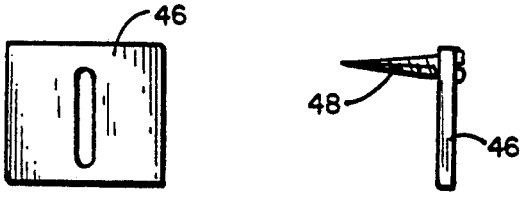
FIG. 6B is a side view of a lock washer.

While the flags 20 are positionable by being laterally extendable from the cassette 12, they desirably should not be removable from the cassette 12 when fully extended. The flag system 10, therefore, desirably contains a blocking mechanism for preventing a flag from being withdrawn from a recess 14 when the flag is fully extended from the cassette 12. In the preferred embodiment, one side of the tail 26 (FIG. 6*a*) of the flag is expanded so that the height of the tail 26 is slightly greater than that of the body 22 of the flag, and slightly less than the height of the recess 14. Similarly, one side of the opening of the recess 14 desirably contains a lip 28 whose length expands downwardly into the recess 14. When a flag is fully extended, the tail 26 of the flag converges with the lip 28 of the recess 12, thereby preventing further extension of the flag.

In addition to being fully retracted within the recess 14 and fully extended outward from the cassette 12, if desired, the flag can be positioned in any intermediate location. To facilitate the positioning of a flag 20 in an intermediate location, in the preferred embodiment, the flag body 22 contains detents 38 on one or both of its sides. The detents 38 create an area for the flag to rest against the opening of the recess 14 in the frame 16, thus securing the flag to the frame.

Figure 3:
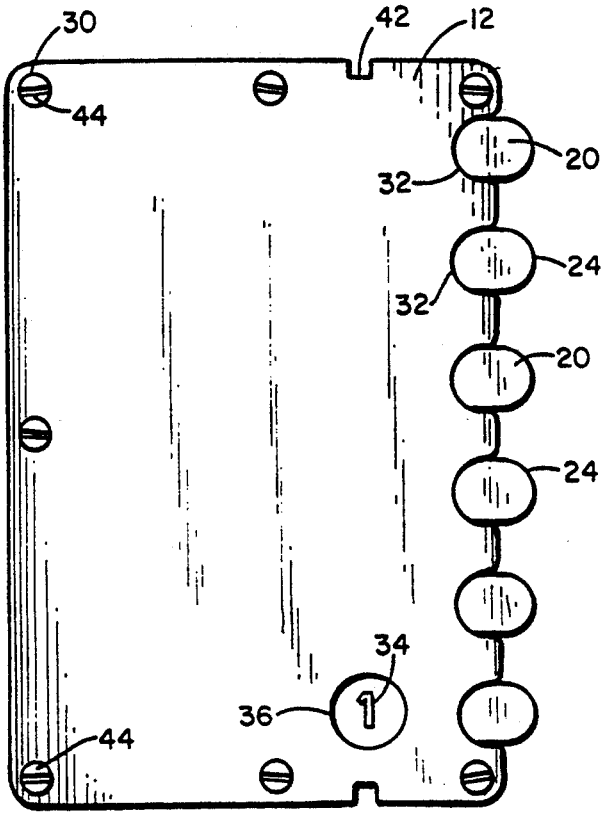
FIG. 3 is a side view of an alternate embodiment of the invention.
Figure 4:
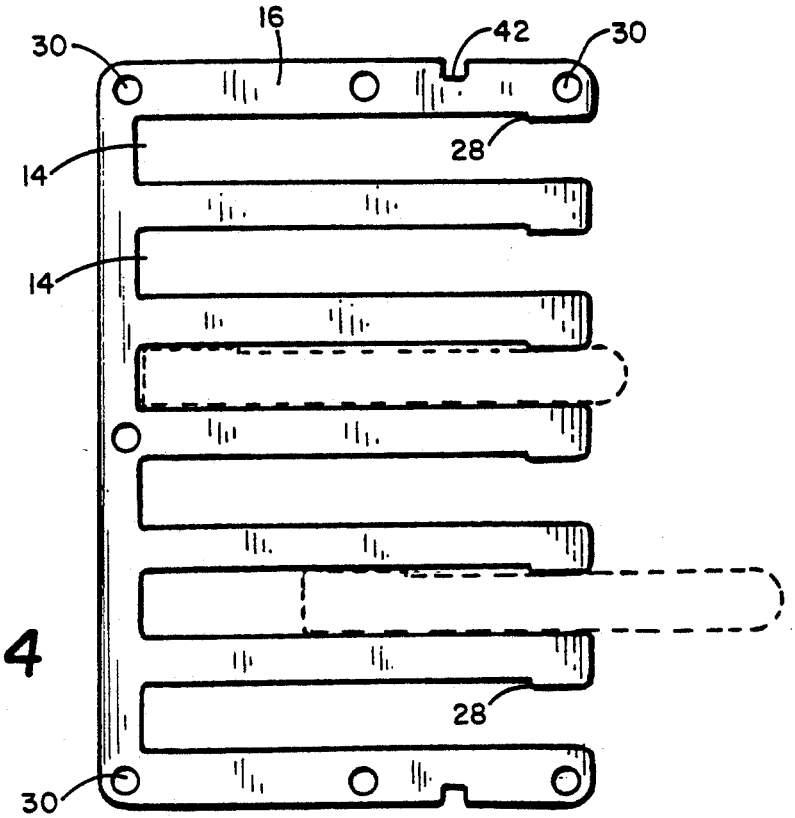
FIG. 4 is a side view of the invention.
Figure 5:
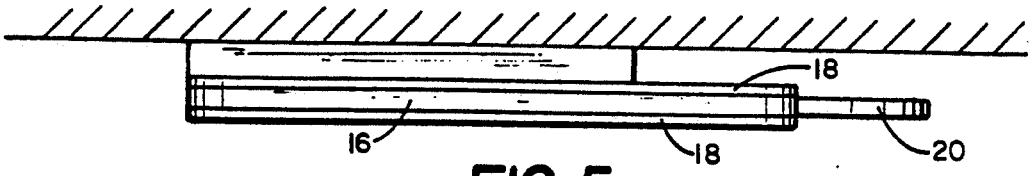
FIG. 5 is a top view of the invention.

In an alternate embodiment, symbols or markings 34 can be placed on one or more of the flags 20 as a means of conveying additional information. As shown in FIGS. 2, 3 and 4, the markings 34 can consist of numbers, letters, words or anything else useful to, or desired by the system operators.

The versatility of the system allows the markings to be used in a variety of ways. For example, the flag body could carry interrelated symbols, only one of which would be desired to be viewed at a time. To enhance the effectiveness of the symbols, in the preferred embodiment, an aperture 36 (FIG. 3) is cut into one of the side walls 18 next to the flag 20 containing the symbols 34. In this way, the information is conveyed to the user by sliding the flag so that the desired symbol is positioned in the aperture 36. Similarly, the flags could be labeled with patient instructions. The instructions could be carried by the body of the flag and be made visible by sliding the flag outward from the cassette.

In an alternate embodiment, the instructions could be carried within the cassette so that the flag obscures the instructions when residing in the recess. The instructions could then be revealed by sliding the flag outward from the cassette.

Each flag is desirably a different color as a means of creating further variables that can be used to provide additional information. Any suitable method of producing the colored flags 20 can be used and their construction is not restricted to any one material. The construction material will primarily be dictated by the needs of the user and the availability of workable materials. In the preferred embodiment, a color strip is placed between two pieces of clear acrylic plastic and then the acrylic is laser cut to produce the flags. In an alternate embodiment, the flags are produced by injection molding.

The flag system 10 desirably includes means for attaching the system to a wall, door or other structure. The flag system 10 can be surface mounted to a structure through the use of glue or a similar substance. Additionally, some of the holes 30 in the frame 16 and side walls 18 can be used to attach the system to a wall or other structure with nails, screws or other securing devices. In the preferred embodiment, "L" brackets or spacers are used for attaching the system to a structure.

Figure 9:
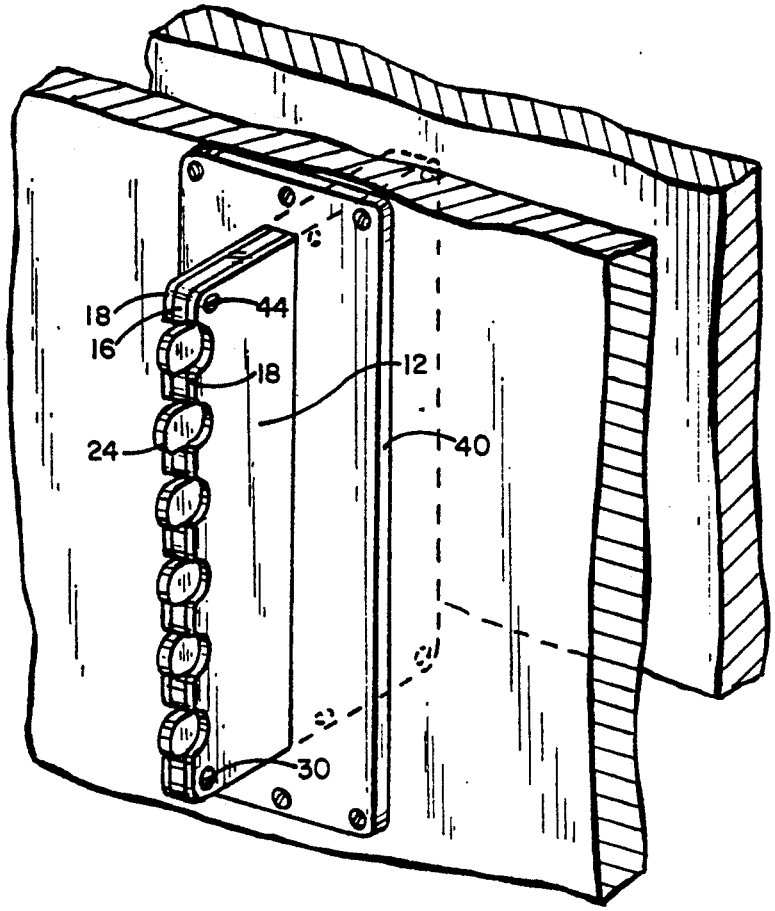
FIG. 9 is a perspective view of the invention.
Figure 7:
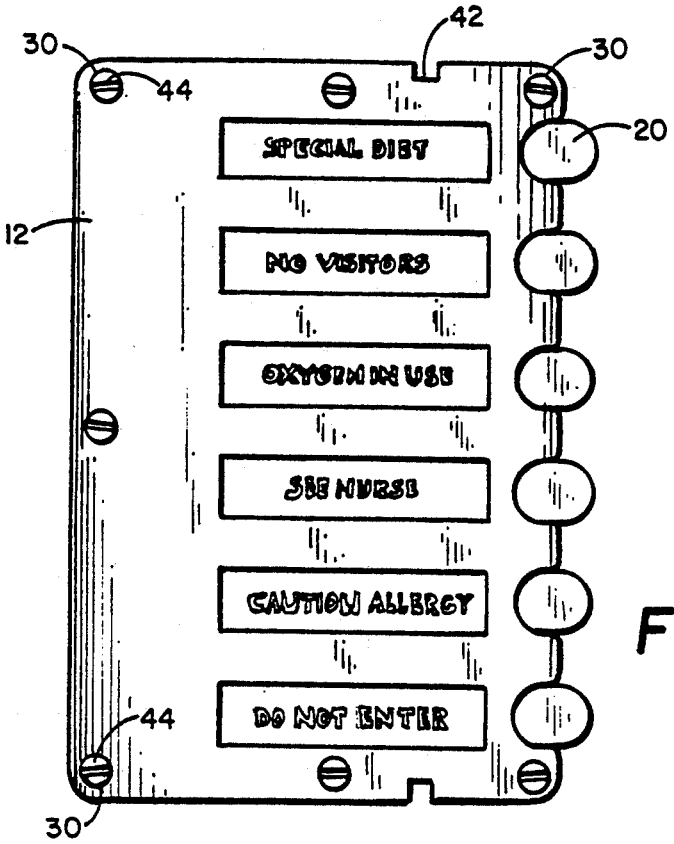
FIG. 7 is a side view of an alternate embodiment of the invention.
Figure 8:
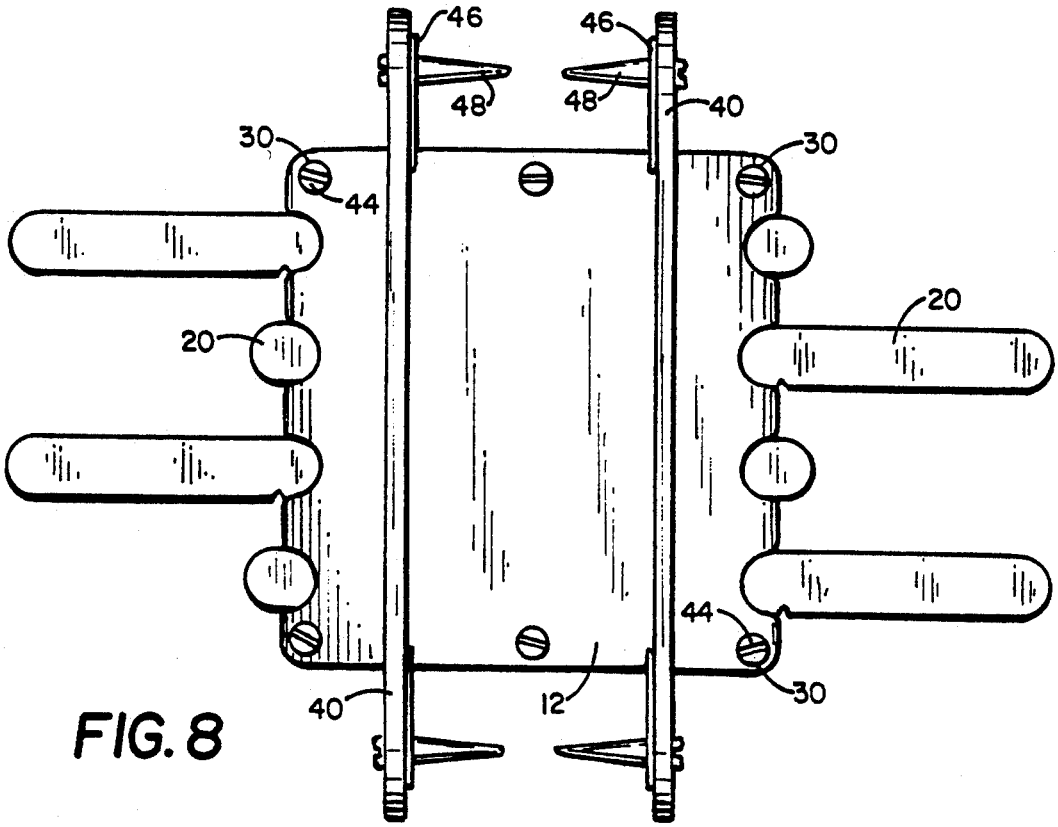
FIG. 8 is a side view of an alternate embodiment of the invention.

In an alternate method of attachment, the flag system 10 is placed within the structure so that the flags protrude perpendicular from the structure with only a portion of the system being exposed. In the preferred embodiment, a flat collar 40 in FIGS. 2, 8 and 9 is provided with an opening for snugly receiving the frame 16 and side walls 18. The collar 40 resides within notches 42 (FIG. 3) on the upper and lower surfaces of the frame 16 and side walls 18. The system 10 is inserted into the structure up to the collar 40 and the collar 40 is then secured to the surface of the structure through appropriate attachment means. A suitable recess may be formed through an office wall to receive the cassette with the collar being firmly attached to the wall. In one embodiment, the collar 40 is secured to the wall by inserting screws through the collar 40 and into anchors 48. The screws are further secured to the collar by being inserted through lock washers 46.

In a further method of attachment, the cassette is mounted through a wall so that the edges extend outward on either side of the wall (FIG. 8). In this way, the system can be activated from either room on either side of the wall. The cassette contains flags that protrude from both of its ends. In this way, the flags can be slid from either side of the wall. Any suitable arrangement could be used, including two cassettes, one cassette with flags on both ends, a cassette with a single set of elongated flags or a single flag of increased width. In the preferred embodiment, the arrangement includes a locking mechanism for prevent the flags from being removed from the recesses.

In use, the flag system 10 is commonly used in a professional establishment where each flag represents a particular person, location or function. A unique feature of the flag system is that it enables the use of any single color flag to be assigned to a doctor or other professional to also be simultaneously assigned for other functions. Functions can be assigned based upon the graphics placed on a flag as well as the distance a flag is extended or retracted from the cassette. Although the flag system 10 is adaptable to diverse applications, a method of using the system for a doctor's office will be discussed for illustrative purposes.

For a doctor's office, individual flag systems 10 may be mounted via the collar 40 to, and within, a wall near each examination room. Each flag 20 of a system is a different color, each color representing a particular doctor. The flags would initially be retracted within the cassette 12, the outer end of which protrudes only slightly into the corridor. As patients are brought into a room, the nurse fully extends the flag 20 that corresponds to the doctor who is to see the patient. By glancing at the cassette 12, the doctor can instantly determine which patient he or she should next attend to.

As mentioned, the system allows for a tremendous variety of variables that can be communicated between the doctors and staff. The doctor or staff member could partially or completely slide the flag back into the cassette, depending upon what information they desire to convey. Similarly, a flag could be moved so that information placed upon the flag or cassette is revealed. For example, when the doctor has completed the examination of the patient, he or she slide their flag 20 back into the cassette 12, thereby informing the nurse that the patient has been seen. If, while examining the patient, the doctor desires to perform some tests on the patient, the doctor slides the flag 20 to an intermediate position, thereby indicating that tests are proceeding inside the room and the doctor should not be disturbed. After the tests are completed, the doctor slides the flag 20 back into the cassette 12.

A similar scenario can be used with flags 20 that contain symbols, such as numbers or letters. If several of a doctor's patients are placed in various examination rooms, the nurse indicates the priority of the patients to the doctor by sliding the flag 20 out of the cassette 12 until the priority number of the patient can be seen in the aperture on the side wall 18. Thus, patients may be designated "1", "2" and "3", or any other label desired by the office. After the doctor has finished with the first patient, the flags 20 are readjusted to reflect the new priority of the patients.

The flags 20 can be adapted to any criteria desired by the user. For example, if at some time a particular patient in the above example becomes more critical than the others, rather then shifting all of the individual flags, the nurse could simply slide the flag outside of the patient's room until the "N" signifying "Next" is positioned in the aperture. Likewise, an office may include a "T" or a "D" on the flag so that the running of tests or the need for a doctor could be indicated.

In alternate scenarios, the flag may carry patient instructions, such as "Special Diet" that would be revealed when the flag is slide outward from the cassette. The instructions could also be carried by the cassette. With the flag retracted within the cassette, the message would ordinarily be obscured. The instructions are made visible by sliding the flag outward from the cassette. Instructions could also be placed upon the cassette or window could be located in the cassette for viewing the instructions.

An advantage of the flag system 10 is its versatility. The above scenario is but one example as to the use of the flag system 10. It is easily seen that the system is adaptable to unlimited uses and that individual flags 20 of a system 10 can be used to represent an unlimited number of characteristics. Additionally, if a flag 20 breaks, or if the user desires a different color scheme, the cassette 12 can be easily disassembled and the flags 20 replaced.

While a preferred embodiment of the present invention has been described, it should be understood that various changes, adaptations and modifications may be made therein without departing from the spirit of the invention and the scope of the appended claims.

What is claimed is:

1. A signaling device, comprising:

a) a cassette containing a plurality of recesses;

b) flags located within the recesses, each of the flags being slidable within a recess so as to position the flags to generate a signal for conveying information; and c) attachment means for attaching the cassette to a structure, the attachment means comprising a collar encompassing the cassette in a perpendicular fashion, the collar being secured to the structure so that the cassette is mounted up to the collar within a recess of the structure.

* * * * *